US005215816A

United States Patent [19]

Shibata et al.

[11] Patent Number: 5,215,816

[45] Date of Patent: Jun. 1, 1993

[54] HOSPITAL TEXTILE

[75] Inventors: Fumio Shibata, Kyoto; Takechi Tedori, Ishikawa; Shunzo Kawasaki, Osaka, all of Japan

[73] Assignee: Teijin Limited, Osaka, Japan

[21] Appl. No.: 896,377

[22] Filed: Jun. 10, 1992

[30] Foreign Application Priority Data

Jun. 17, 1991 [JP] Japan ..... 3-170444

[51] Int. Cl.[5] ..... B32B 7/00

[52] U.S. Cl. ..... 428/266; 428/225; 428/226; 428/229; 428/257; 428/258; 428/259; 428/373; 428/260; 428/265; 428/421

[58] Field of Search ..... 428/225, 226, 229, 257, 428/258, 259, 266, 373, 260, 265, 421

[56] References Cited

U.S. PATENT DOCUMENTS 4,822,667 4/1989 Goad et al. ..... 428/225

FOREIGN PATENT DOCUMENTS 0153155 8/1985 European Pat. Off. .

*Primary Examiner*—James J. Bell

*Attorney, Agent, or Firm*—Sughrue, Mion, Zinn, Macpeak & Seas

[57] ABSTRACT

A hospital textile suitable for operating gowns comprising a low air permeable fabric woven from continuous polyester filaments together with continuous conductive polyester filaments arranged at appropriate intervals in a warp and/or weft direction thereof, a surface of the fabric being composed of fine-denier filaments having a monofilament denier of 1.2 or less, and a water repellent finish being applied to the fabric, which is low in lint or dust generation and excellent in antistatic properties, having resistivity against degradation due to repeated uses and due to steam treatment for disinfection and sterilization, and against degradation due to γ-ray irradiation, can prevent the adhesion and penetration of the body fluid or blood as well as the outward filtration of lint or dust emitted from underwears, and has desirable soft hand.

28 Claims, No Drawings

HOSPITAL TEXTILE

BACKGROUND OF THE INVENTION

The present invention relates to hospital textiles having low lint or dust generation, excellent in antistatic properties and water repellency, and having low air permeability. More particularly, the invention relates to hospital textiles suitable for operating gowns, nursing gowns, covering cloths, wrapping cloths, hamper bags and the like to prevent adhesion and penetration of body fluid or blood.

Previously, cotton products have been used as operating gowns, nursing gowns, covering cloths, wrapping cloths and the like, and water repellent finishes have been applied thereto as so desired. However, the hospital textile products made of cotton generate a large amount of lint or dust, due to falling off of cotton fibers, and wear and degradation thereof.

With the development of medical techniques, difficult operations have recently been performed one after another. In such circumstances, a problem is caused by the above-described lint or dust. For example, bacteria are scattered by floating dust.

U.S. Pat. No. 4,822,667 proposes fabrics tightly woven from continuous polyester filaments to prevent trouble caused by floating dust.

Recently, however, various high technology instruments are used in operating rooms and the like. When synthetic fiber fabrics are used, therefore, problems are encountered such as malfunction of the instruments resulting from static electricity inherent in the synthetic fibers also arises.

U.S. Pat. No. 4,822,667, mentioned above, discloses that a polyester woven fabric is finished with a pad bath containing an antistatic compound to dissipate static electricity.

It is, however, difficult to obtain a hospital textile having durable antistatic properties by the finishing treatment as described above. In addition, some compounds used for the finishing treatment also contribute to the generation of dust.

SUMMARY OF THE INVENTION

It is therefore an object of the present invention to provide a hospital textile suitable for applications such as operating gowns, nursing gowns, covering cloths, wrapping cloths and hamper bags that does not contribute to lint or dust generation, which subsequently causes the bacteria scattering mentioned above, or to the generation of static electricity, and which can prevent the adhesion and penetration of body fluid or blood.

According to the present invention, there is provided a hospital textile suitable for applications such as operating gowns, nursing gowns, covering cloths, wrapping cloths and hamper bags, which comprises a low air permeable fabric woven from continuous polyester filaments, said fabric containing continuous conductive polyester filaments arranged at appropriate intervals in a warp and/or weft direction thereof, a surface of the fabric being composed of fine-denier filaments having a monofilament denier of 1.2 or less, and a water repellent finish being applied to the fabric.

DETAILED DESCRIPTION OF THE PREFERRED EMBODIMENTS

The present invention will hereinafter be described in detail. Hospital textiles of the present invention are fundamentally required to show high resistivity against degradation due to repeated uses and due to steam treatment for disinfection and sterilization, and against degradation due to γ-ray irradiation. From this viewpoint, the hospital textiles of the present invention are required to be composed of polyester yarn, and, further, the yarn has to be continuous filaments from the viewpoint of the prevention of dust generation. Further, continuous conductive polyester filaments are arranged at appropriate intervals in a warp and/or weft direction of the fabric. Namely, the same material as that of the continuous polyester filaments, of which the fabric is comprised, is used as the matrix-forming conductive filaments. Thus, the whole fabric has the characteristics of resistivity against degradation due to repeated uses and treatment for disinfection and sterilization, and of low dust generation.

Furthermore, the fabric is tightly woven to give low air permeability. The reason for this is that not only does the woven fabric prevent the penetration of body fluid or blood, but also it resists the degradation from repeated use by virtue of its tight structure.

However, even if the fabric meets the above-described three requirements, namely the use of the continuous polyester filaments, the use of the continuous conductive polyester filaments, and the achievement of low air permeability of the fabric attained by virtue of the tight structure thereof, the fabric can not prevent the penetration of body fluid or blood satisfactorily for hospital textiles yet. Accordingly, a water repellent finish is applied to the fabric to make the prevention of the penetration of body fluid or blood more perfect. Furthermore, this finish treatment contributes to the prevention of filtration of lint or dust emitted from underwear.

In the present invention, the term "polyester" means an aromatic polyester obtained by polycondensation of an aromatic dicarboxylic acid, preferably terephthalic acid, or its ester-forming derivative, preferably dimethyl terephthalate, and an alkylene glycol, preferably ethylene glycol.

The continuous polyester multifilaments comprising fine-denier filaments having a monofilament denier of 1.2 or less, preferably 0.1 to 0.5, and a total denier of about 50 to 300 are used as warps and/or wefts. Thus, the penetration of body fluid or blood and the outward filtration of lint or dust resulting from the underwear can be prevented and tight fabric having soft hand can be obtained.

The continuous conductive polyester filaments used in combination with the continuous polyester filaments are usually of 1 to 3 filament counts, and they are used alone or in the form of twisted yarn with other multifilaments. Such continuous conductive filaments are arranged at intervals of 0.5 to 3 cm in a warp and/or weft direction of the fabric, Examples of the continuous conductive polyester filaments include coating type filaments coated with conductive materials such as carbon, copper iodide and so on, sheath-core conjugate type filaments in which core portions contain conductive materials, filaments in which conductive materials are dispersed, and surface adsorption type filaments on the surfaces, i.e., peripheral portions, of which conductive materials are adsorbed. When importance is attached to low dust generation and durability, the sheath-core conjugate type filaments in which the core portions contain the conductive materials such as carbon or tin oxide are particularly preferred. Further, for white fabrics or fabrics dyed in other colors, continuous filaments not colored with carbon are preferably used. For example, the filaments on the surfaces of which the conductive materials such as copper iodide are adsorbed are preferred.

In the present invention, as a measure of the low air permeability of the fabrics attained by their tight woven structure, the air permeability measured according to JIS L1096, the fragier process, is adopted. This value is preferably 10 cc/cm$^2$/sec or less, and more preferably 5 cc/cm$^2$/sec or less. If the air permeability exceeds 10 cc/cm$^2$/sec, the fabric structure becomes rather coarse, which causes difficulty in preventing the outward filtration of lint or dust generated from the underwear and also the penetration of body fluid or blood. On the other hand, if this value is less than 0.5 cc/cm$^2$/sec, the fabric lacks air permeability, which results in discomfort when used as operating gowns, nursing gowns, covering cloths and the like.

For imparting water repellency to the above-described fabric, the fabric is treated with known water repellents such as silicone series agents and fluorine series agents by the use of a padding process, a coating process, a spray process or the like. As another means, filaments which themselves are water repellent may also be used. Further, water repellents and filaments which are water repellent may be used in combination. The water repellents are generally used in an amount of 3 to 15% based on the fabric weight.

In a preferred embodiment of the present invention, a combined (intermingled) filament yarn or twisted yarn comprised of continuous low-shrinkage filaments and continuous high-shrinkage filaments is used as the continuous polyester filaments. When fabric woven using such combined filament yarn or twisted union yarn is subjected to shrinkage treatment, the low-shrinkage filaments appear on the surfaces of the fabric to form loops. The loops thus formed not only prevent the penetration of body fluid or blood, and repel the lint or dust inherent in underwear, but also act to repel body fluid or blood conversely.

In this case, fabrics having soft surface touch can be obtained by using fine-denier filaments having a monofilament denier of 1.2 or less as the continuous low-shrinkage filaments. If the denier is less than 0.2, however, the loop holding property becomes unstable and reduces the activity of repelling the body fluid or blood.

As the continuous low-shrinkage filaments, filaments low in shrinkage having a shrinkage percentage of 1 to 10% as measured by boiling water treatment are preferably used.

The continuous filaments low in shrinkage can be produced, for example, by sufficiently heat treating filaments in a usual filament manufacturing stage or in another stage.

Further, as the continuous high-shrinkage filaments, filaments having a monofilament denier of 1.0 to 4.5 are preferred in order to give the fabric anti-drape tightness or resilient stiffness and not to make it so harsh. As the continuous high-shrinkage filaments, filaments high in shrinkage having a shrinkage percentage of 10 to 50% as obtained by boiling water treatment are preferably used. The continuous filaments high in shrinkage can be produced, for example, by omitting heat treatment after drawing or heat treating at reduced temperature in a usual filament manufacturing stage, or by modifying the polymers of which the filaments are formed.

The ratio of the continuous low-shrinkage filaments to the continuous high-shrinkage filaments in the intermingled or combined filament yarn or the twisted union yarn can be, for example, 3:1 to 1:3 by weight.

The continuous polyester filament yarn composing the hospital textiles of the present invention may be any of flat (not textured) yarn, false twist textured yarn, and a section of which may be circular or noncircular, as long as it is of a continuous filament type.

The intermingled or combined filament yarn can be produced by air texturing processes such as the interlacing process and the Taslan texturing process. When the twisted yarn is produced, the number of twists is 1,500 turns/m or less, and preferably 300 to 600 turns/m with provision that the yarn denier is about 110.

The hospital textiles of the present invention acts as follows:

(1) The fabrics are made of the continuous polyester filaments and the continuous conductive polyester filaments are arranged therein. Accordingly, the fabrics are low in lint or dust generation and excellent in antistatic properties, and also exhibit resistivity against degradation due to repeated uses and due to steam treatment for disinfection and sterilization, and against degradation due to $\gamma$-ray irradiation.

(2) In addition to the above-described characteristics of the material and form, the fabrics are low in air permeability due to their tight structure, so that body liquid or blood are prevented from penetrating the fabrics. In particular, when the loops are allowed to exist on the surface of the fabric, the specific function of repelling the body liquid or blood is exhibited. At the same time, the durability of the fabrics to repeated uses is improved by their tight structure. Coupled with the characteristics of the continuous polyester filaments, this causes a further improvement in durability.

(3) Coupled with the tight structure of the fabric and the water repellent finish conducted on the fabric, the water repellency of the whole fabric reveals the effect of preventing the penetration of body fluid or blood more perfect as well as the outward filtration of lint or dust emitted from the underwear.

(4) When the filaments comprising the fine-denier filaments are employed as the continuous polyester filaments, the fabrics having soft hand can be obtained, and ideal products having functions required for the hospital textiles as well as functions required for the general textiles are obtained.

The present will hereinafter be illustrated by the following examples in more detail.

The effects of the present invention were evaluated by the following processes:

Tearing strength: JIS L1096

Water repellency: JIS L1092, spray process

Dust generation: JIS B9923, tumbling process

Antistatic properties: JIS L1094, frictional charge voltage process

Air permeability: JIS L1096, fragile process

Liquid repellency: the resistance to wetting by body liquid was evaluated in accordance with JIS L1092 using water instead of urine. ◎: 80 marks or more, ○: less than 80 marks to 70 marks, Δ: less than 70 marks to 60 marks, ×: less than 60 marks Blood repellency: Few drops of the horse blood were adhered and shaken off after 3 minutes, and the stained state was visually determined. ○: not adhered or slightly adhered, Δ: adhered to some extent, ×: remarkably adhered

EXAMPLE 1

A fabric of 121 ends per inch and 70 picks per inch was woven using interlaced combined filament yarn comprised of 50-denier, 24-filament polyester multifilament yarn having a shrinkage percentage in boiling water of 14% and 64-denier, 144-filament polyester multifilament yarn having a shrinkage percentage in boiling water of 6% as warps and wefts, and twisted union yarn comprising the above-described interlaced filament yarn and a 27-denier conductive polyester monofilament containing copper iodide is arranged therein at a rate of one yarn per 26 ends. The fabric thus obtained was scoured and relaxed by a conventional method, followed by dying with a disperse dye of green color. After drying, a water repellent finish was conducted by the padding method using a solution supplemented with 5% by weight of a commercial repellent (Asahiguard LS317, Asahi Glass Co, Ltd.) and 3% by weight of isopropyl alcohol. After drying, finish setting was carried out, followed by calender treatment with paper rolls at a temperature of 160° C.

For the water repellent fabric thus treated, the properties shown in Table 1 were evaluated. Results thereof are shown in Table 1.

EXAMPLE 2

A water repellent fabric was obtained in the same manner as with Example 1 with the exception that soaping was conducted with a solution containing 1 g/liter of a nonionic surface active agent (Sunmole SX10, Nikka Kagaku Kogyo) at 70° C. for 10 minutes before the calender treatment with the paper rolls, and the soaped fabric was washed with hot water and then with water and dried, followed by the above-described calender treatment.

For the resulting water repellent fabric, the properties shown in Table 1 were evaluated. Results thereof are shown in Table 1.

COMPARATIVE EXAMPLE 1

A fabric whose weaving standards are the same as with Example 1 was finished in the same manner as with Example 1 with the exception that no conductive polyester filament was used.

For this fabric, the properties shown in Table 1 were evaluated. Results thereof are shown in Table 1.

COMPARATIVE EXAMPLE 2

A operating gown made of drill of ⅓ twill weave (single yarn having a cotton count of 14 is used as both warps and wefts) was produced from 100% cotton yarn commercially available for use as the same purpose. Also for this gown, the properties were evaluated similarly with Example 1. Results thereof are shown in Table 1.

EXAMPLE 3

A fabric of 125 ends per inch and 94 picks per inch was woven using 75-denier, 72-filament fine-denier false twist textured polyester multifilament yarn as warps and wefts, and a 27-denier conductive polyester monofilament containing copper iodide is arranged therein at a rate of one filament per 26 ends. The fabric thus obtained was scoured and relaxed by a conventional method, followed by dying with a disperse dye of green color. After drying, a water repellent finish was conducted by the padding method using a solution supplemented with 10% by weight of a commercial repellent (Asahiguard LS317, Asahi Glass Co, Ltd.) and 3% by weight of isopropyl alcohol. After drying, finish setting was carried out, followed by calender treatment with paper rolls at a temperature of 160° C.

For the water repellent fabric thus treated, the properties shown in Table 1 were evaluated. Results thereof are shown in Table 1.

TABLE 1

| | | Example 1 | Example 2 | Comparative Example 1 | Comparative Example 2 | Example 3 |
|---|---|---|---|---|---|---|
| METSUKE | | 135 | 135 | 135 | 135 | 95 |
| Air Permeability ($cc/cm^2/sec$) | | 1.0 | 0.9 | 0.8 | 17 | 1.2 |
| Tearing Strength (g) | SL0 | 2,750 | 2,700 | 2,700 | 2,800 | 1,300 |
| | | X1,200 | X1,180 | X1,190 | X3,200 | X1,400 |
| | SL20 | 2,350 | 2,400 | 2,450 | 1,800 | 1,150 |
| | | X1,150 | X1,200 | X1,180 | X1,900 | X1,200 |
| | SL40 | 2,000 | 2,050 | 2,100 | 1,700 | 800 |
| | | X1,000 | X950 | X1,020 | X1,670 | X900 |
| Water Repellency | SL0 | 100 | 100 | 100 | 100 | 100 |
| | SL20 | 90 | 90 | 90 | 0 | 90 |
| | SL40 | 70 | 80 | 80 | 0 | 80 |
| Antistatic Properties (warp direction) | SL0 | 1,600 | 1,650 | 3,000 | 300 | 1,800 |
| | SL20 | 1,500 | 1,600 | 5,500 | 500 | 1,700 |
| | SL40 | 1,500 | 1,550 | 5,000 | 350 | 1,700 |
| Dust Generation (dust/L) | SL0 | 150 | 40 | 120 | 7,000 | 200 |
| | SL20 | 100 | 10 | 90 | 13,000 | 150 |
| | SL40 | 80 | 15 | 90 | 13,500 | 100 |
| Liquid Repellency | SL0 | ◎ | ◎ | ◎ | ○-Δ | ◎ |
| | SL40 | ○ | ○ | ○ | x | ○ |
| Blood Repellency | SL0 | ○ | ○ | ○ | Δ | ○ |
| | SL40 | ○-Δ | ○-Δ | ○-Δ | x | ○-Δ |

Note: SLn means that washing treatment (JIS L0217 103 process) and steam treatment (at 130° C. for 10 minutes) were conducted n times alternately.

What is claimed is:

1. A hospital textile comprising a low air permeable woven fabric comprising continuous polyester filaments and continuous conductive polyester filaments arranged at appropriate intervals in at least one of a warp and weft direction, wherein a surface of the fabric comprises fine-denier filaments having a monofilament denier of 1.2 or less, and a water-repellant finish, said finish is imparted to the fabric by treating the fabric with at least one water repellent or by using filaments which are water repellent.

2. The hospital textile claimed in claim 1, wherein the polyester used in the continuous polyester filaments and the continuous conductive polyester filaments is an aromatic polyester obtained by polycondensation of an aromatic dicarboxylic acid or its ester-forming derivative and an alkylene glycol.

3. The hospital textile claimed in claim 2, wherein the aromatic dicarboxylic acid is terephthalic acid.

4. The hospital textile claimed in claim 2, wherein the ester-forming derivative is dimethyl terephthalate.

5. The hospital textile claimed in claim 2, wherein the alkylene glycol is ethylene glycol.

6. The hospital textile claimed in claim 1, wherein the continuous polyester filaments comprise fine-denier filaments having a monofilament denier of 1.2 or less and a total denier of about 50 to 300.

7. The hospital textile claimed in claim 6, wherein the continuous polyester filaments are used as at least one of warp and wefts.

8. The hospital textile claimed in claim 6, wherein the monofilament denier is 0.1 to 0.5.

9. The hospital textile claimed in claim 1, wherein the continuous conductive polyester filaments have a filament count of 1 to 3.

10. The hospital textile claimed in claim 9, wherein the continuous conductive polyester filaments are used alone or in the form of twisted yarn with other multifilaments.

11. The hospital textile claimed in claim 9, wherein the continuous conductive filaments are arranged at intervals of 0.5 to 3 cm in the at least one of warp and weft direction of the fabric.

12. The hospital textile claimed in claim 1, wherein the continuous conductive polyester filaments are selected from the group consisting of coating filaments, sheath-core conjugate filaments, filaments in which a conductive material is dispersed, and surface adsorption filaments.

13. The hospital textile claimed in claim 12, wherein the surface adsorption filaments comprise a conductive material adsorbed on the peripheral portion of each of the filaments.

14. The hospital textile claimed in claim 1, wherein the low air permeability has a value of 10 $cc/cm^2/sec$ or less.

15. The hospital textile claimed in claim 14, wherein the value is 5 $cc/cm^2/sec$ or less.

16. The hospital textile claimed in claim 1, wherein the water repellent is selected from the group consisting of silicone series agents and fluorine series agents.

17. The hospital textile claimed in claim 1, wherein the water repellent is used in an amount of 3 to 15% based on the weight of the fabric.

18. The hospital textile claimed in claim 1, wherein the continuous polyester filaments comprise a combination of filament yarn or twisted yarn comprised of continuous low-shrinkage filaments and continuous high-shrinkage filaments.

19. The hospital textile claimed in claim 18, wherein the continuous low-shrinkage filaments are fine-denier filaments having a monofilament denier of 1.2 or less.

20. The hospital textile claimed in claim 18, wherein the monofilament denier of the continuous low-shrinkage filaments is in the range of 0.2 to 1.2 denier.

21. The hospital textile claimed in claim 18, wherein the continuous low-shrinkage filaments have a shrinkage percentage of 1 to 10%.

22. The hospital textile claimed in claim 18, wherein the continuous high-shrinkage filaments comprise filaments having a monofilament denier of 1.0 to 4.5.

23. The hospital textile claimed in claim 18, wherein the continuous high-shrinkage filaments have a shrinkage percentage of 10 to 50%.

24. The hospital textile claimed in claim 18, wherein the ratio of the continuous low-shrinkage filaments to the continuous high-shrinkage filaments in the filament yarn or the twisted yarn is 3:1 to 1:3 by weight.

25. The hospital textile claimed in claim 1, wherein the continuous polyester filaments are selected from the group consisting of flat yarn and false twist textured yarn.

26. The hospital textile claimed in claim 25, wherein a section of the flat yarn or false twist textured yarn is circular or non-circular.

27. The hospital textile claimed in claim 18, wherein the twisted yarn has a number of twists of 1,500 turns/m or less provided that the yarn denier is about 110.

28. The hospital textile claimed in claim 27, wherein the number of twists is 300 to 600 turns/m.

* * * * *

UNITED STATES PATENT AND TRADEMARK OFFICE

CERTIFICATE OF CORRECTION

PATENT NO. : 5,215,816

DATED : June 1, 1993

INVENTOR(S) : SHIBATA ET AL

It is certified that error appears in the above-indentified patent and that said Letters Patent is hereby corrected as shown below:

Column 3, line 50, delete "0.2" and insert --0.1 --.

Column 8, claim 20, line 3, delete "0.2" and insert --0.1 --.

Signed and Sealed this

First Day of March, 1994

Bruce Lehman

*Attest:*

BRUCE LEHMAN

*Attesting Officer*

*Commissioner of Patents and Trademarks*